US005513399A

United States Patent [19]

Weng

[11] Patent Number: 5,513,399

[45] Date of Patent: May 7, 1996

[54] FOLDING PLAY CRIB STRUCTURE

[76] Inventor: Kuan-Jen Weng, No.3-12 Min Jue Rd., Sing Ying, Tainan, Taiwan

[21] Appl. No.: 319,576

[22] Filed: Oct. 7, 1994

[51] Int. Cl.[6] ..... A47D 7/00

[52] U.S. Cl. ..... 5/98.1; 5/99.1

[58] Field of Search ..... 5/98.1, 98.3, 99.1

[56] References Cited

U.S. PATENT DOCUMENTS

| | | | |
|---|---|---|---|
| 5,243,718 | 9/1993 | Shamie | 5/99.1 |
| 5,279,006 | 1/1994 | Teng | 5/98.1 |
| 5,293,656 | 3/1994 | Chan | 5/99.1 |
| 5,353,451 | 10/1994 | Hsiung | 5/99.1 |
| 5,358,220 | 10/1994 | Yu-Kuang | 5/99.1 |

*Primary Examiner*—Michael F. Trettel
*Attorney, Agent, or Firm*—Beveridge, DeGrandi, Weilacher & Young

[57] ABSTRACT

A folding play crib structure comprising frame tubes, corner joints, middle joints, central bottom joint, U-shaped tubes, V-shaped pull rods, bottom cross tubes and leg joints. One end of the frame tube is pivotally connected with an insert seat which cooperates with the joints for controlling the locking and folding of the crib structure. The U-shaped tubes are pivotally connected at the central portion of the bottom cross tubes to enhance the supporting effect for the bottom of the crib structure. V-shaped pull levers are pivotally connected on one side of the U-shaped tube, whereby when folding the cross tubes, the U-shaped tubes are also folded to ensure safety and more reliably support the crib structure at multiple points of the bottom thereof.

3 Claims, 6 Drawing Sheets

FOLDING PLAY CRIB STRUCTURE

BACKGROUND OF THE INVENTION

The present invention relates to a folding play crib structure.

A play crib is important to an infant as the crib prevents the infant from falling down onto the ground due to negligence. However, the early play crib has considerably large volume. Therefore, a folding crib is developed for easy storage.

Taiwanese Patent Publication No. 218102 discloses a conventional folding play crib which is mainly composed of upper, lower and lateral support rods, connecting sleeves, folding bodies, leg tubes, pivot bodies and U-shaped base frames. One end of the upper support rod is pivotally connected with the connecting sleeve by a locating member and the other end thereof is fixedly connected at the folding body. The lateral support rod is fixedly connected between the connecting sleeve and the leg tube and the lower support rod is pivotally connected between inner leg tube and the pivot body. The two U-shaped base frames are pivotally assembled with the pivot bodies into an integral body. The above conventional folding crib is characterized in that the folding body is formed by radially arranged right rod members having dented grooves in which a resilient member and an insert block are disposed. The insert block is formed with a periphery corresponding to the dented groove of the right rod member and is left and right slidable therein. Sector-shaped projections are formed on left side of the insert block and corresponding sector-shaped projections are formed on right side of the left rod member to interlacedly engage with one another. The left rod member, insert block, resilient member and right rod member are fixedly assembled with the pivot shaft into an integral body by a nut. A tenon is disposed at one end of the pressing block to be engaged with and located on the left rod member for pressing the insert block. Accordingly, when the upper support rod is horizontally supported with the folding bodies parallel to each other, the folding bodies are fixedly locked without folding and the entire structure is firmly supported without deforming. When pressing down the pressing block, the folding bodies are unlocked and foldable and the whole structure can be folded for storage.

The pivot body is a V-shaped seat body and equally spaced recesses are formed at two ends thereof for pivotally connecting with corresponding projections of the connecting sleeve. A sleeve section formed at one end of the connecting sleeve is used to locate the lower support rod. A hole is formed at a central portion of the lower end of the pivot body for the pivot shaft to pivotally connect with the U-shaped base frame. Accordingly, four lower support rods and two U-shaped base frames are interlacedly connected under the crib structure for stably supporting the same. The pivot body structure permits the crib structure to be folded toward the center thereof into a small frame body which will not occupy much room. In addition, the U-shaped base frame is formed with multiple inner reinforcing ribs and a hole at one end for pivotally connecting with the pivot body, Whereby the crib structure is more reliably supported.

Several Shortcomings exist in the above arrangements as follows:

1. The support rods are folded by means of the right and left rod members of the folding body, which are formed with radial dented grooves in cooperation with the insert blocks and resilient members. However, when folded, the left rod members are pressed from one side to downward press and fold the support rods. Therefore, the left rod members are likely to be touched by mistake. Moreover, the support rods are downward foldable so that in case the folding body is pressed and folded downward incautiously, the crib will collapse suddenly. This will cause danger to the infant sleeping in the crib.

2. The folding body of the conventional folding crib has complicated components so that many molds are necessary for manufacturing the folding body. Therefore, the manufacturing cost for the folding crib is relatively high.

3. The conventional folding crib is composed of the V-shaped seat body, lower support rods and U-shaped base frames which are pivotally assembled to form a supporting structure for the crib. Such assembly has excessively large space between respective components so that the folding board is often depressed in use. This is unsafe to the infant sleeping in the crib.

SUMMARY OF THE INVENTION

It is a primary object of the present invention to provide a folding play crib structure in which one end of the frame tube is pivotally connected with an insert seat which is formed with an arch recess for pivotally connecting with a joint. A locking rod is used to engage with two insert seats to lock the frame tubes and prevent the same from being folded. When folded, the joints must be first slightly lifted to make the arch recess of the insert seat separate from the locking rod and then the control lever is pressed to make the locking rod totally separate from the insert seat and permit the frame tubes to be simultaneously folded downward. Therefore, the folding procedure includes two steps and the frame tubes of the crib structure are prevented from being suddenly folded by mistake so that the security can be ensured.

It is a further object of the present invention to provide the above crib structure in which U-shaped tubes are pivotally connected at the central portion of the bottom Cross tubes to enhance the supporting effect for the bottom of the crib structure.

It is still a further object of the present invention to provide the above crib structure in which V-shaped pull levers are pivotally connected on one side of the U-shaped tube, whereby when folding the cross tubes, the U-shaped tubes are pulled and rotated by the V-shaped pull levers and folded along with the bottom cross tubes.

The present invention can be best understood through the following description and accompanying drawings, wherein:

DETAILED DESCRIPTION OF THE PREFERRED EMBODIMENT

Figure 1:
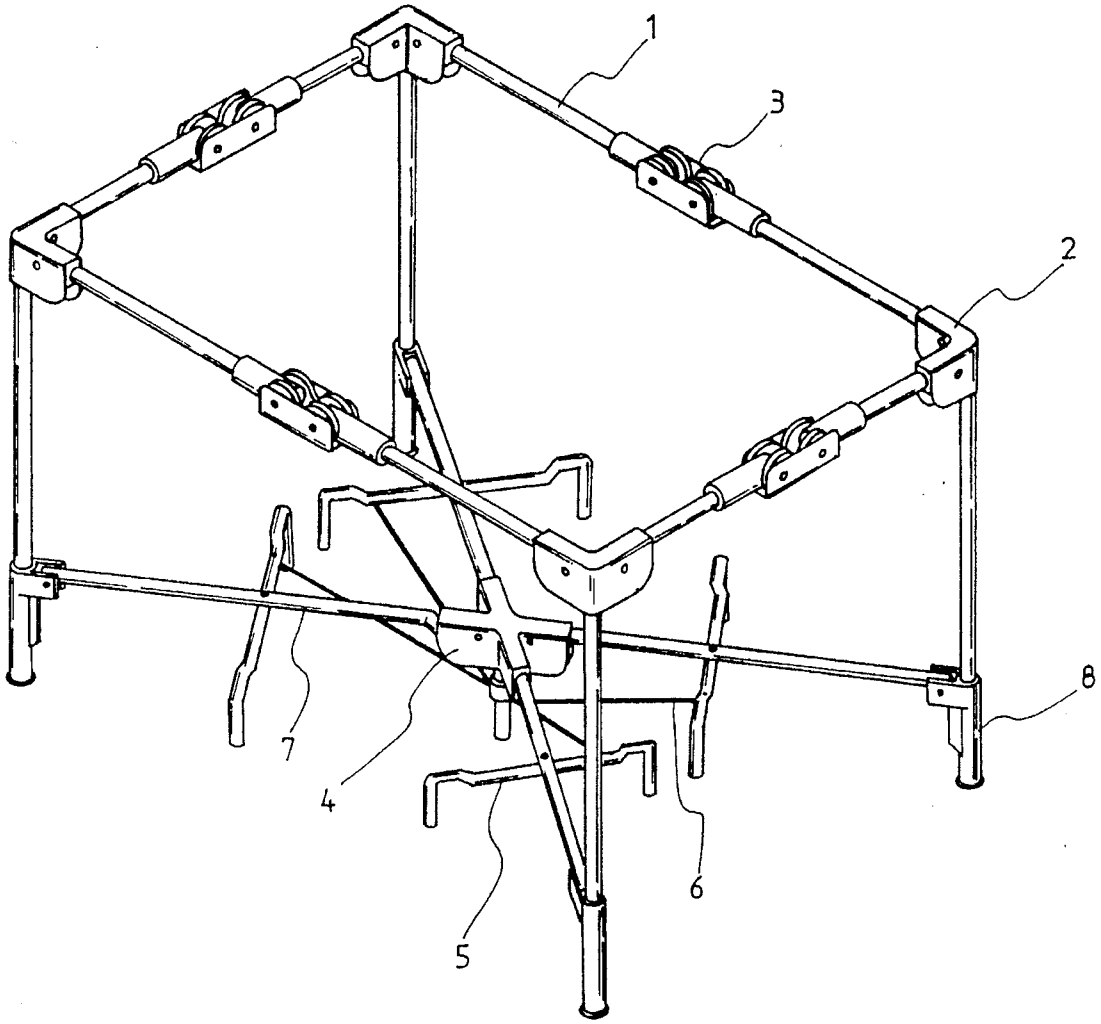
FIG. 1 is a perspective assembled view of the present invention.

Please refer to FIG. 1. The folding play crib structure of the present invention is mainly composed of frame tubes 1, corner joints 2, middle joints 3, central bottom joint 4, U-shaped tubes 5, V-shaped pull rods 6, bottom cross tubes 7 and leg joints 8. The corner joints 2 and leg joints 8 are conventional ones.

Figure 2:
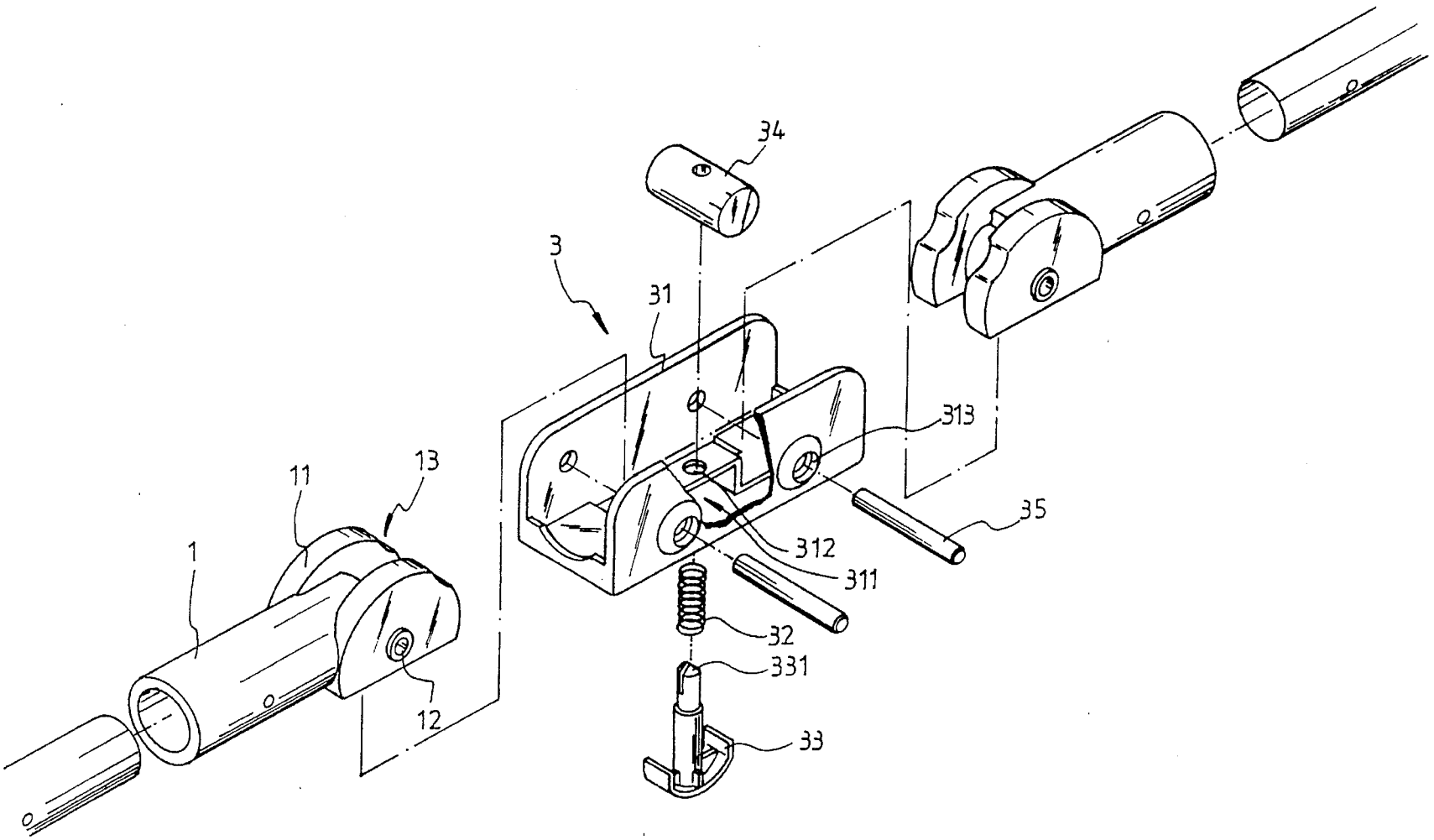
FIG. 2 is a perspective exploded view of the joint of the present invention.

Please refer to FIG. 2. One end of the frame tube 1 is pivotally connected with the corner joint 2 and the other end thereof is pivotally connected with an insert seat 11 formed with a through pivot hole 12 and disposed with an arch insert recess 13.

The middle joint 3 as shown in FIG. 2 includes a pivot seat 31, a resilient member 32, a control lever 33 and a locking rod 34, wherein the pivot seat 31 is disposed with a chamber for receiving two insert seats 11 and a central inner recess 311 for receiving the control lever 33. A through hole 312 is formed at a central portion of the recess 311 for the control lever 33 to pass therethrough. Two through holes 313 are respectively disposed on two sides of the pivot seat 31, whereby two insert pins 35 can be inserted into the through holes 313 to pivotally connect with the insert seats 11 of the frame tubes 1. The control lever 33 has an insert hook 331 extending from a front end thereof, whereby the control lever 33 can be fitted with the resilient member 32 and passed through the central through hole 312 of the recess 311 and the control lever 33 can be passed through the locking rod 34 with the insert hook 331 engaged with the locking rod 34. Therefore, the locking rod 34 can engage with the arch recess 13 of the insert seat 11 to locate the frame tube 1 and prevent the same from being folded. When holding the joint 3 and slightly lifting the same, the locking rod 34 is separated from the arch recess 13 of the insert seat 11. Meanwhile, the control lever 33 is upward forced to move the locking rod 34 upward so as to fold the frame tubes 1.

Figure 3:
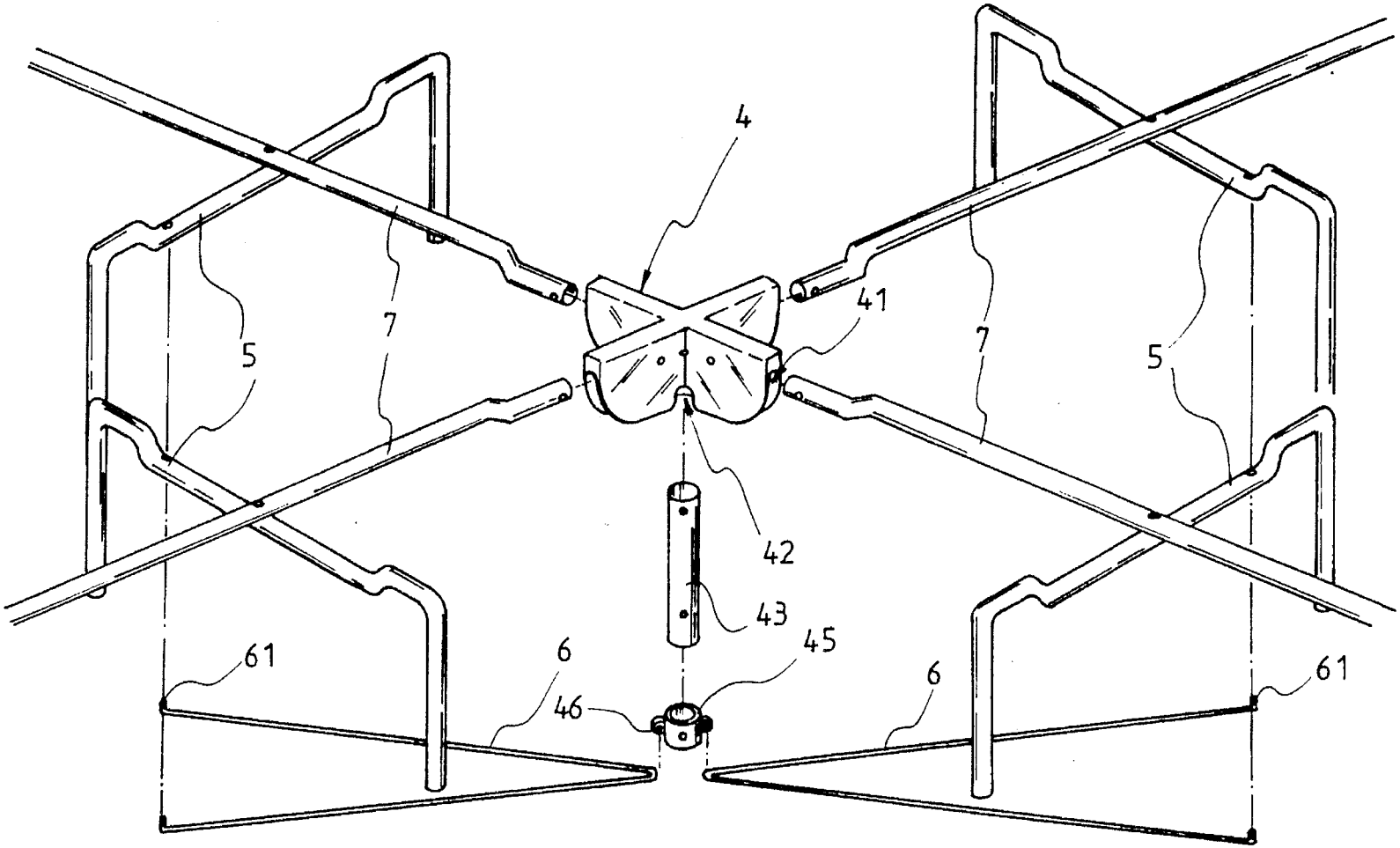
FIG. 3 is a perspective exploded view of the cross tubes of the present invention.

Please refer to FIG. 3. The bottom central joint 4 is substantially X-shaped and formed with chambers 41 at respective ends for receiving the cross tubes 7. A circular hole 42 is formed at a central portion of the central joint 4 for a fixing rod 43 to insert thereinto. A pull lever seat 45 is fitted with the fixing rod 43 and two pivot lugs 46 extend from two sides of the pull lever seat 45.

Please refer back to FIG. 1. The frame tubes 1 are connected between the corner joints 1 and the middle joints 3 and the cross tubes 7 are connected between the bottom central joint 4 and the leg joints 8. The U-shaped tubes 5 are pivotally connected at the central portion of the cross tubes 7. The V-shaped pull levers 6 are passed through the pivot lugs 46 of the pull lever seat 45. An upward extending support rod 61 of the V-shaped pull lever 6 is pivotally connected with on one side of the U-shaped tube 5.

Figure 4:
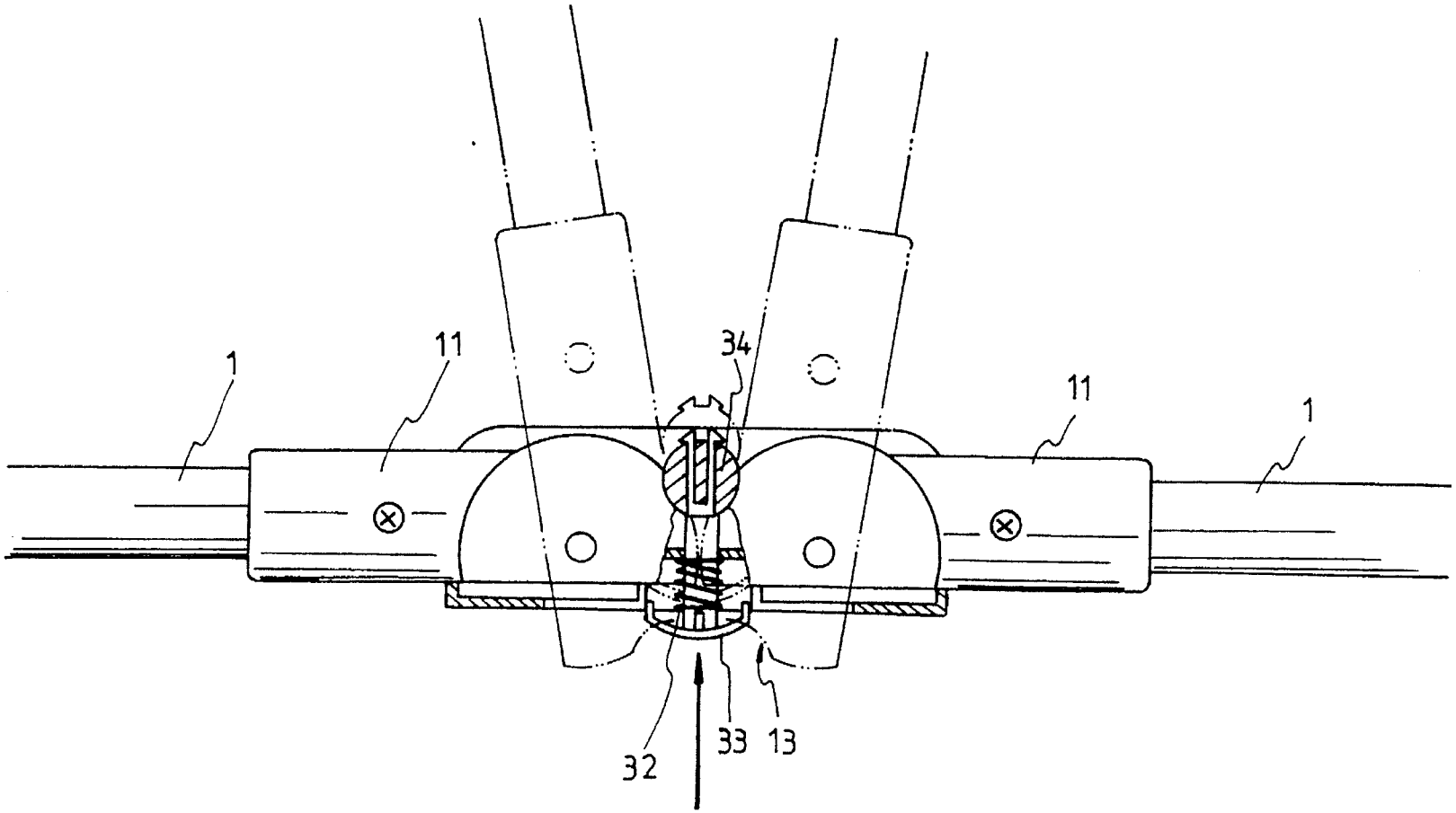
FIG. 4 shows the folding operation of the joint of the present invention.
Figure 5:
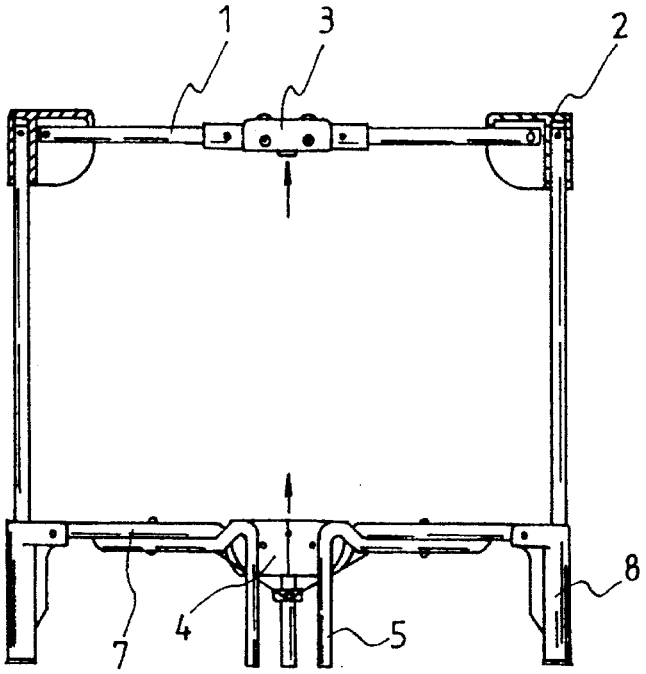
FIG. 5 shows the present invention in an unfolded state.
Figure 6:
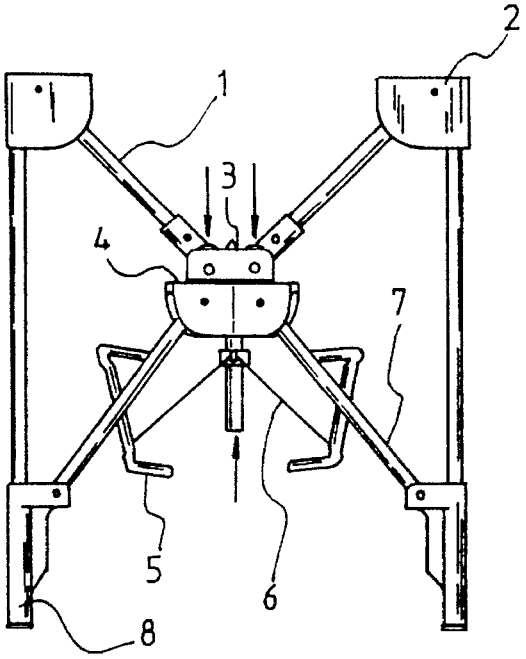
FIG. 6 shows the present invention in a folding state.
Figure 7:
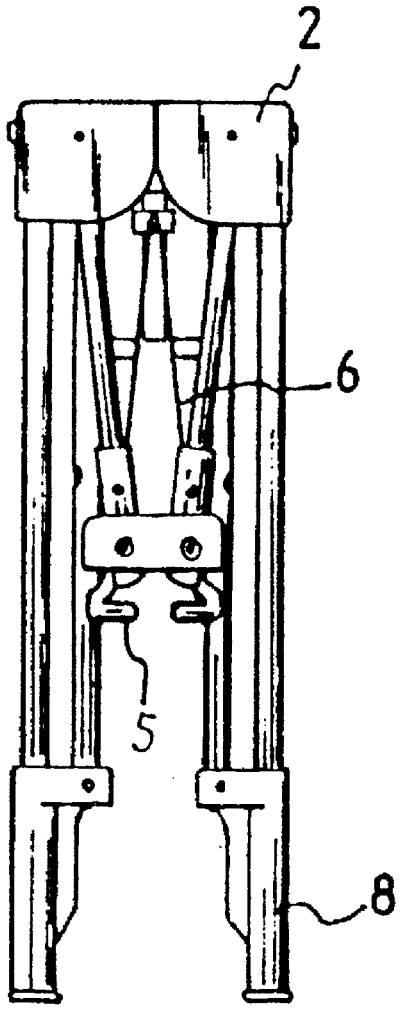
FIG. 7 shows the present invention in a folded state.

Please refer to FIG. 4. The locking rod 34 of the joint 3 is engaged with the arch recess 13 of the insert seat 11 to support the frame tubes 1 and prevent the same from being folded. In addition, the bottom central joint 4, cross tubes 7, leg joints 8, V-shaped pull levers 6 and U-shaped tubes 5 form the bottom support structure as shown in FIG. 1. When folded, as shown in FIGS. 5 and 6, the joint 3 is first slightly lifted, making the arch recess 13 separate from the locking rod 34. Then the control lever 33 is forced upward to urge the locking rod 34 to totally separate from the insert seat 11, permitting the frame tubes 1 to be folded downward. Meanwhile, the bottom central joint 4 is lifted to fold the bottom cross tubes 7 and the V-shaped pull levers 6 are used to pull the U-shaped tubes 5, permitting the U-shaped tubes 5 to be rotated and attached under the cross tubes 7 and folded along with the cross tubes 7. FIG. 7 shows the folded crib structure which has relatively small volume for easy storage.

It can be known from the above that the present invention has the following advantages:

1. When folded, the Joints must be first lifted and then the control lever is pressed to fold the frame tubes. Therefore, the folding procedure includes two steps and the crib structure is prevented from being suddenly folded by mistake so that the security can be ensured.

2. The bottom board of the crib is supported not only by the cross tubes but also by the U-shaped tubes so that the bottom board is more firmly supported without easily collapsing.

3. The V-shaped pull levers are pivotally connected on one side of the U-shaped tube, whereby when folded, the V-shaped pull levers rotate the U-shaped tube to be folded along with the bottom cross tubes.

The above preferred embodiment is only an example of the present invention and the scope of the present invention should not be limited to the example. Any modification or variation derived from the example should fall within the Scope of the present invention.

What is claimed is:

1. A folding play crib structure comprising frame tubes, corner joints, middle joints, a bottom central joint, U-shaped tubes, V-shaped pull levers, bottom cross tubes and leg joints, wherein:

one end of each of the frame tubes is pivotally connected with a pivot hole of an insert seat provided in an arch insert recess;

each of the middle joints includes a pivot seat formed with a chamber for receiving two insert seats and a central inner recess for receiving a control lever, a through hole being formed at a central portion of the central inner recess for the control lever to pass therethrough, two through holes being respectively disposed on two sides of the pivot seat, whereby two insert pins are adapted to be inserted into the through holes to pivotally connect with the insert seats of two of the frame tubes, the control lever having an insert hook extending from a front end thereof, whereby the control lever is adapted to be fitted with a resilient member and passed through the through hole of the central inner recess, and the control lever is adapted to be passed through a locking rod with the insert hook engaged with the locking rod; and the bottom central joint is substantially X-shaped and formed with chambers at respective ends for receiving the bottom cross tubes, the U-shaped tubes being pivotally connected at a central portion of the bottom cross tubes, a fixing rod being connected under a central portion of the bottom central joint, a pull lever seat being fitted with the fixing rod and two pivot lugs extending from two sides of the pull lever seat, the V-shaped pull levers being passed through the pivot lugs of the pull lever seat, two ends of each of the V-shaped pull levers being pivotally connected to two of the U-shaped tubes, whereby the frame tubes are controllably foldable by means of the above joints, and when folding the bottom cross tubes, the V-shaped pull levers are urged to lift the bottom central joint so as to fold the bottom cross tubes and rotate the U-shaped tubes through a certain angle at the same time.

2. A folding play crib structure, comprising:

plural frame tubes, wherein a first end of each of the frame tubes is connected with an insert seat provided in an arch insert recess;

plural corner joints, wherein a second end of each of said frame tubes is connected to a respective one of said corner joints, and wherein a leg extends from each corner joint;

plural middle joints, wherein the first end of each of said frame tubes is connected to a respective one of said middle joints, and wherein each of the middle joints includes:

a pivot seat formed with a chamber for receiving two insert seats connected to two of the frame tubes, a central inner recess for receiving a control lever, wherein the control lever includes an insert hook extending from a front end thereof, whereby the control lever is adapted to be fitted with a resilient member and passed through a through hole defined in the central inner recess and the control lever is adapted to be passed through a locking rod with the insert hook engaged with the locking rod, two through holes respectively disposed on two sides of the pivot seat, whereby two insert pins are adapted to be inserted into the through holes to connect with the insert seats of two of the frame tubes;

plural leg joints, wherein one leg joint is connected at a first end of each of said legs;

plural bottom cross tubes, wherein a first end of each of said bottom tubes connects with a respective one of said plural leg joints;

a central bottom joint, wherein the central bottom joint is substantially X-shaped and formed with chambers at respective ends for receiving a second end of each of said bottom cross tubes;

a fixing rod connected under a central portion of the central bottom joint;

a pull lever seat connected to the fixing rod, wherein two pivot lugs extend from two sides of the pull lever seat;

plural U-shaped tubes, wherein one of said U-shaped tubes is connected at a central portion of a respective one of said bottom cross tubes;

plural V-shaped pull levers, wherein one of said V-shaped pull levers is passed through a respective one of the pivot lugs of the pull lever seat, wherein each of the V-shaped pull levers includes:

a first end which is connected to one of said U-shaped tubes and a second end which is connected to another of said U-shaped tubes, wherein when the bottom cross tubes are folded, the V-shaped pull levers lift the central bottom joint so as to fold the bottom cross tubes and rotate the U-shaped tubes.

3. A folding play crib structure, comprising:

plural frame tubes, wherein a first end of each of the frame tubes is connected with an insert seat provided in an arch insert recess;

plural corner joints, wherein a second end of each of said frame tubes is connected to a respective one of said corner joints, and wherein a leg extends from each corner joint;

plural middle joints, wherein the first end of each of said frame tubes is connected to a respective one of said middle joints, and wherein each of the middle joints includes:

a pivot seat formed with a chamber for receiving two insert seats connected to two of the frame tubes, two through holes respectively disposed on two sides of the pivot seat, whereby two insert pins are adapted to be inserted into the through holes to connect with the insert seats of two of the frame tubes;

plural leg joints, wherein one leg joint is connected at a first end of each of said legs;

plural bottom cross tubes, wherein a first end of each of said bottom cross tubes connects with a respective one of said plural leg joints;

a central bottom joint, wherein the central bottom joint is substantially X-shaped and formed with chamber at respective ends for receiving a second end of each of said bottom cross tubes;

a fixing rod connected under a central portion of the central bottom joint;

a pull lever seat connected to the fixing rod, wherein two pivot lugs extend from two sides of the pull lever seat;

plural U-shaped tubes, wherein one of said U-shaped tubes is connected at a central portion of a respective one of said bottom cross tubes;

plural V-shaped pull levers, wherein one of said V-shaped pull levers is passed through a respective one of the pivot lugs of the pull lever seat, wherein each of the V-shaped pull levers includes:

a first end which is connected to one of said U-shaped tubes and a second end which is connected to another of said U-shaped tubes.

* * * * *